United States Patent [19]

Johannes

[11] 3,966,117

[45] June 29, 1976

[54] CENTRIFUGE DISCHARGE DEVICE

[75] Inventor: Walter Johannes, Rochester, N.Y.

[73] Assignee: Eastman Kodak Company, Rochester, N.Y.

[22] Filed: June 6, 1975

[21] Appl. No.: 584,557

[52] U.S. Cl. ..... 233/19 A; 233/21; 233/46; 415/89

[51] Int. Cl.[2] ..... B04B 11/02

[58] Field of Search ..... 233/46, 21, 22, 19 A, 233/19 R; 415/89

[56] References Cited

UNITED STATES PATENTS

| | | | |
|---|---|---|---|
| 2,154,134 | 4/1939 | Millar | 233/22 |
| 2,284,362 | 5/1942 | Birmann | 415/89 |

FOREIGN PATENTS OR APPLICATIONS

| | | | |
|---|---|---|---|
| 68,005 | 11/1948 | Denmark | 233/21 |
| 481,061 | 8/1929 | Germany | 233/20 R |

*Primary Examiner*—George H. Krizmanich
*Attorney, Agent, or Firm*—S. W. Gremban

[57] ABSTRACT

A device for use in discharging a fluid from a fluid processing apparatus. In accordance with one aspect of the invention, the device is suitable for those applications requiring both a low level of surface turbulence and a relatively high level of sub-surface turbulence. Low levels of surface turbulence generally result in small amounts of splashing and foaming, and also enable an effective fluid level to be established. Higher levels of sub-surface turbulence are often necessary in order to redisperse particles which might have migrated or settled in the fluid.

12 Claims, 5 Drawing Figures

CENTRIFUGE DISCHARGE DEVICE

BACKGROUND OF THE INVENTION

1. Field of the Invention

This invention relates to a device for use in discharging a fluid from a fluid processing apparatus such as a spinning centrifuge bowl. In accordance with the invention, the discharge device is so designed as to permit its use in applications wherein only small amounts of surface turbulence are tolerable. In accordance with another aspect of the invention, the device is further designed for applications requiring low levels of surface turbulence and yet relatively high levels of sub-surface turbulence.

2. Description of the Prior Art

Many types of scoop devices for discharging fluid material from fluid processing apparatus are known in the art. The most common type of scoop device is the pipe scoop, or a variation thereof, which basically comprises a stationary pipe of suitable diameter bent such that the pipe opening is oriented to "scoop up" the fluid material moving past it. To improve upon the basic tube scoop design, certain modifications are common, such as tapering the pipe to increase the pressure of the discharged material, or adding a splash guard to catch the fluid material splashed as a result of surface turbulence. In addition, it is known to adjust the scoop level, i.e., the depth in the fluid material at which the scoop is positioned, whereby fluid material from a range of depths may be discharged. Also, efforts have been expended to streamline the basic pipe scoop design in order to reduce turbulence, thereby reducing levels of splashing and foaming.

A skimming tube is disclosed in U.S. Pat. No. 3,228,595 suitable for use in discharging a liquid from a spinning centrifuge bowl. As a result of a streamlined tube design, the skimming tube produces lowered levels of turbulence throughout the liquid. Reduced turbulence results in reduced splashing and foaming, thereby enabling the skimming tube to be employed in applications wherein foaming adversely affects the quality of the liquid. Cited examples of such liquids are orange juice which suffers a taste deterioration when aerated, and reducing agents such as photographic developers which lose effectiveness when mixed with air.

While the disclosed skimming tube is suitable for use with liquids such as orange juice and photographic developers, it does not function adequately when used with a viscous fluid. In this case, the viscous fluid does not flow into the leading openings as easily as it flows around the body. As a result, the viscous fluid tends to "back up" in front of the disclosed skimmer tube producing levels of turbulence and splashing which are unacceptable in certain applications for which the present invention is proposed.

In addition, unlike photographic developers, some types of fluids which are adversely affected by aeration and commonly discharged from fluid processing apparatus of the type including a spinning centrifuge bowl, are not solutions but rather suspensions or emulsions. In this type of fluid, particles originally dispersed throughout the liquid or gel tend to migrate, under the influence of centrifugal force, away from the center of the spinning centrifuge bowl. For use in these applications, the discharge device should not only be designed to produce minimal surface turbulence, but also should provide enough sub-surface turbulence, especially towards the bottom of the fluid, to keep the particles dispersed throughout the fluid, thereby inhibiting particle build-up along the bottom of the centrifuge bowl.

In the specification and accompanying claims the term "sub-surface" is used. Herein, sub-surface is understood to refer to any portion of the fluid substantially below the surface.

SUMMARY OF THE INVENTION

In accordance with the present invention, the preferred embodiment discloses a device for use in discharging a fluid from a fluid processing apparatus. The fluid processing apparatus is of the type having means for causing relative motion to occur between the fluid and the discharge device. This relative motion may be obtained by movement of the fluid or the discharge device or a combination of both. In addition, the fluid processing apparatus is adapted with means for positioning the device in the fluid.

The preferred embodiment describes a discharge device comprising a streamlined body having a narrow leading edge. Means are provided for defining at least one inlet port in the streamlined body. An outlet tube extends from the body and means are further provided for defining a passageway connecting the inlet port to the outlet tube.

During operation, the predescribed discharge device is positioned in the fluid to such a depth as to submerge the inlet port. As the fluid is caused to flow relatively with respect to the device, the leading edge "parts" the relatively moving fluid which then flows in a streamlined flow pattern around and past the streamlined body. A portion of the relatively moving fluid is sheared from the main flow by the inlet port, which fluid thereby flows through the passageway and is discharged through the outlet tube.

In accordance with another aspect of the invention, a dispersing member is mounted near the bottom of the predescribed discharge device. The dispersing member provides sufficient sub-surface turbulence to inhibit particles dispersed in the fluid from migrating toward the bottom of the fluid and settling therein. In spite of the sub-surface turbulence, the streamlined flow produced by the shape of the streamlined body has a sufficient damping effect upon the sub-surface turbulence, to enable a relatively high level of sub-surface turbulence to coexist with a relatively low level of surface turbulence. Thus, in accordance with this aspect of the invention, the discharge device is suitable for applications requiring small amounts of splashing and foaming, and at the same time requiring a capability of redispersing particles in the fluid.

In accordance with still another aspect of the present invention, one or more sensing probes are mounted proximate to the leading edge of the discharge device for sensing the fluid level. Since the leading edge "cuts" through the fluid, the fluid level at the leading edge is most accurately representative of the fluid level in the fluid processing apparatus. A controlling means is provided for maintaining or changing the fluid level. The fluid level sensing probes generate a signal indicative of the fluid level and the signal is transmitted to the controlling means by a transmitting means.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENT

Figure 1:
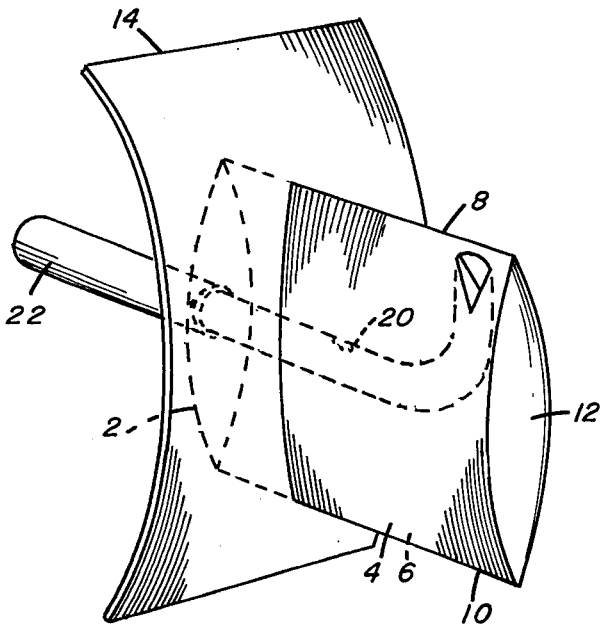
FIG. 1 is a perspective view of a discharge device and is the preferred embodiment of the invention.
Figure 1A:
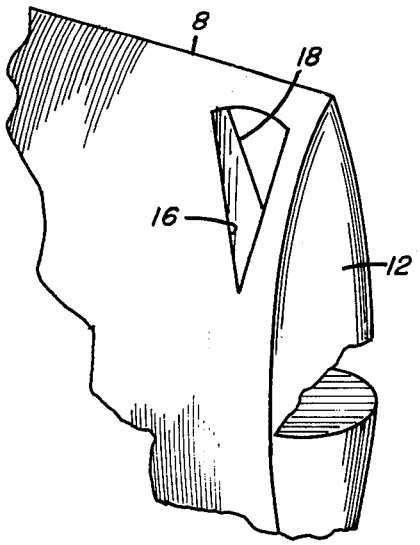
FIG. 1*a* is an enlarged view of a portion of the embodiment of FIG. 1, showing the inlet port construction in more detail.

Referring to FIGS. 1 and 1*a*, the discharge device comprises a top surface 2, two rounded side surfaces 4 and 6 which join together to form a leading edge 8 and a trailing edge 10, a bottom surface 12, a splash guard 14, and two intake ports 16 and 18 connected by a common passageway 20 to an outlet tube 22.

During operation the discharge device is immersed in a fluid such that the inlet ports 16 and 18 are submerged. As fluid is caused to flow past the device, a portion of the fluid enters the intake ports 16 and 18, flows through the passageway 20, and is discharged through the outlet tube 22. The rounded side surfaces 4 and 6 together with the front edge 8 cooperate to present a streamlined geometry to the moving fluid. The front edge 8 is a knife edge which cuts through the fluid, thus offering little resistance even to fluids of gel viscosities. As a result, levels of turbulence are kept low and splashing and foaming are greatly controlled. Whatever fluid is splashed by the front edge 8 or the rounded side surfaces 4 and 6 is caught by the splash guard 14 and subsequently drains back into the fluid.

Figure 2:
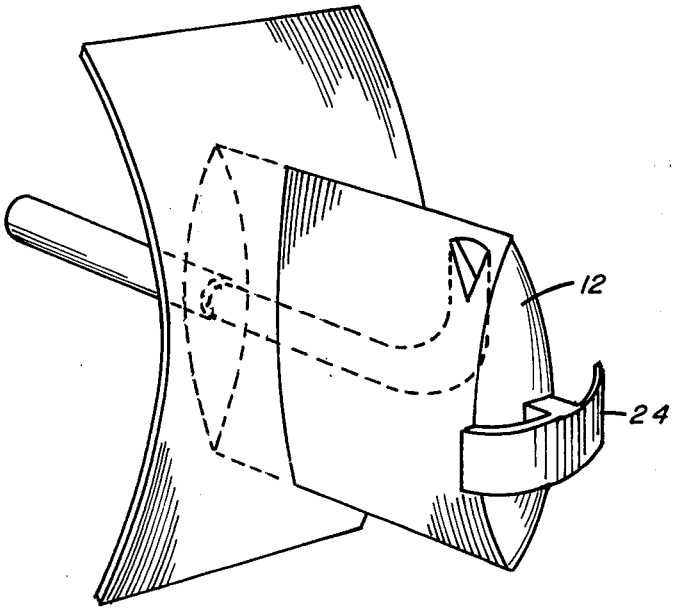
FIG. 2 is a perspective view of the discharge device shown in FIG. 1 with the modification that a dispersing member has been added.

In the modification of the disclosed embodiment shown in FIG. 2, a dispersing member 24 is mounted on the bottom surface 12 thereby producing a turbulent fluid flow near the bottom of the fluid. The net effect is that the turbulent fluid flow produced by the dispersing member 24 tends to dampen out as it interacts with the streamlined fluid flow produced by the upper portions of the discharge device. Thus, while the fluid flow near the bottom of the fluid is relatively turbulent, the fluid flow near the surface remains relatively streamlined. Therefore, if particles in the fluid migrate toward the bottom of the fluid, they tend to be redispersed by the turbulent flow.

Figure 3:
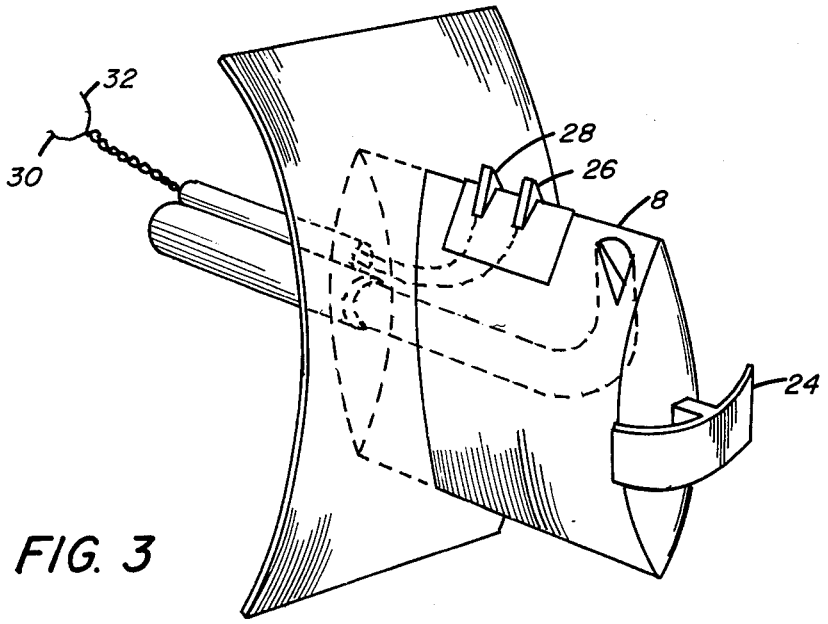
FIG. 3 is a perspective view of the discharge device shown in FIG. 2 with the further modification that fluid level sensing probes have been added.

In the modification of the disclosed embodiment shown in FIG. 3, two sensing probes 26 and 28 are mounted on the front edge 8 for sensing the fluid level impinging upon the front edge 8. The fluid level sensing probes 26 and 28 are connected by wires 30 and 32 to suitable means, such as an inlet valve or outlet valve, for controlling the amount of fluid in the fluid processing apparatus. When the sensing probe 26 senses that the fluid level has dropped below a predetermined level, the level of fluid may be raised by suitable means. Similarly, when the sensing probe 28 senses that the fluid level has risen above a predetermined level, the fluid level may be lowered by suitable means. Thus, the fluid may be maintained at any desired level, or range of levels, by suitably adjusting the height and relative spacing of the sensing probes 26 and 28.

If the discharge device produced a turbulent fluid flow with considerable splashing, the level of fluid would not be well defined. The fluid level would vary somewhat haphazardly and the fluid would splash onto the probes causing a false indication of the fluid level. It is only because the surface turbulence is low that a meaningful fluid level exists and can be accurately measured.

It will be apparent to those skilled in the art that, in accordance with the present invention, for certain applications it may be desirable to eliminate certain features. There are several possibilities, but as one example, suppose a device is required to produce substantial sub-surface turbulence and yet maintain relatively low levels of surface turbulence, and it is not required that the fluid be discharged through this device, then the inlet ports, passageway and outlet tube could be eliminated.

Figure 4:
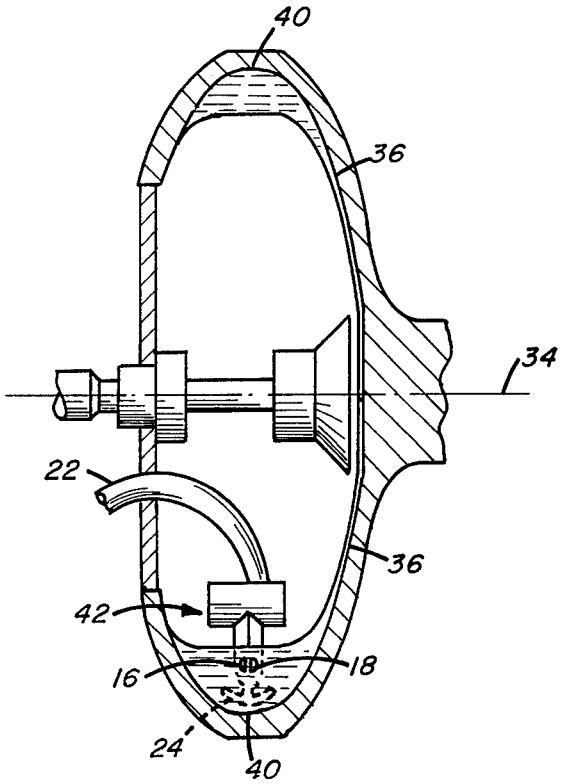
FIG. 4 illustrates one application of the discharge device shown in FIG. 2.

FIG. 4 illustrates one application of the preferred embodiment of the invention. In this application, the fluid material comprises a suspension of silver salt in a viscous medium and is referred to as an emulsion. The emulsion is supplied to a centrifuge having a rotatable centrifuge bowl for purposes of defoaming. In this particular application, the centrifuge is an example of a fluid processing apparatus. As the emulsion is added generally at the axis of rotation 34 of the rotating bowl, the centrifugal force tends to spread the emulsion in a thin film over a defoaming surface 36 wherein defoaming occurs. The defoamed emulsion is collected in a collection section 40 wherein the fluid moves with the rotating centrifuge bowl. The defoamed emulsion is expelled from the centrifuge by a stationary discharge device 42, the discharge device 42 being positioned by means of the outlet tube 22 such that the inlet ports 16 and 18 are submerged in the emulsion. The dispersing member 24 produces sufficient sub-surface turbulence to prevent the silver salt from migrating under the influence of centrifugal force to the bottom levels of the emulsion. As previously described, the streamlined design of the discharge device ensures low levels of splashing and foaming.

Although the discharge device shown in the drawings has a straight narrow leading edge, various other geometries are available in accordance with the present invention. As one example, the body may possess a "rocket-like" shape having a generally pointed front portion for parting the relatively moving fluid. In this embodiment, inlet ports are located at any desired positions around the rocket-like body. In particular, the body must be capable of parting the relatively moving fluid without introducing excessive resistance to the moving fluid.

The invention has been described in detail with particular reference to preferred embodiments thereof, but it will be understood that variations and modifications can be effected within the spirit and scope of the invention.

I claim:

1. A discharge device for use in discharging a fluid from a fluid processing apparatus, the apparatus having means for causing relative motion of the fluid with respect to said discharge device, and the apparatus further having means for positioning said discharge device in the fluid, said discharge device comprising:

a body having a pair of converging side surfaces defining a leading surface on said body, whereby when said body is positioned in a fluid and the fluid is caused to move relatively to said body, said leading surface parts the fluid, thereby enabling the fluid to flow around and past said body in a generally streamlined flow pattern;

means defining at least one inlet port in one of said side surfaces;

an outlet tube extending from said body; and means defining a passageway connecting said inlet port to said outlet tube, said inlet port being effective to shear a portion of the relatively moving fluid into said passageway for discharge from said outlet tube.

2. A device as claimed in claim 1, wherein a dispersing member is located on said body, said dispersing member producing sub-surface turbulence of the fluid, thereby inhibiting the migration and the settling of particles in the fluid.

3. A device as claimed in claim 1, wherein at least one sensing probe is mounted to said body for producing a signal indicating a predetermined level of fluid.

4. A discharge device for use in discharging a fluid from a fluid processing apparatus, the apparatus having means for causing relative motion of the fluid with respect to said discharge device, and the apparatus further having means for positioning said discharge device in the fluid, said discharge devices comprising:

a body having a pair of converging side surfaces defining a straight narrow leading edge, whereby when said body is positioned in a fluid and the fluid is caused to move relatively to said body, said leading edge parts the fluid, whereupon the fluid flows in a generally streamlined flow pattern around and past said body;

means defining at least one inlet port in one of said side surfaces;

an outlet tube extending from said body; and means defining a passageway connecting said inlet port to said outlet tube, said inlet port being effective to shear a portion of the relatively moving fluid into said passageway for discharge from said outlet tube.

5. A device as claimed in claim 4 wherein a dispersing member is located on said body, said dispersing member producing sub-surface turbulence of the fluid, thereby inhibiting the migration and the settling of particles in the fluid.

6. A device as claimed in claim 4, wherein at least one sensing probe is mounted to said body for producing a signal indicating a predetermined level of fluid.

7. A device for discharging fluid from a centrifuge bowl, the bowl provided with means for rotation, whereupon as the bowl rotates, the fluid contained in the bowl moves relatively to said device, said device comprising:

a body having a top surface, a bottom surface, and two outwardly curved side surfaces, said side surfaces being joined together to form a front edge and a rear edge, whereby during operation, said front edge parts the relatively moving fluid, whereupon the fluid flows in a generally streamlined flow pattern around said body and past the rear edge;

at least one inlet port in one of said side surfaces of said body;

an outlet tube located rearwardly, as defined by the direction of fluid flow, in relation to said inlet port;

a passageway connecting said inlet port to said outlet tube, whereby a portion of the relatively moving fluid enters said inlet port, passes through said passageway, and is expelled by said outlet tube.

8. A device as claimed in claim 7, wherein a dispersing member is located near the bottom of said body, said dispersing member producing sub-surface turbulence of the fluid, thereby inhibiting the migration and settling of particles in the fluid.

9. A device as claimed in claim 7, wherein at least one sensing probe is located near said front edge for producing a signal indicating a predetermined level of fluid.

10. A device as claimed in claim 1, wherein said leading surface of said body is a straight narrow leading edge substantially perpendicular to the direction of fluid flow.

11. A device as claimed in claim 4 wherein said straight narrow leading edge is substantially perpendicular to the direction of fluid flow.

12. A device as claimed in claim 7 wherein said front edge is straight and substantially perpendicular to the direction of fluid flow.

* * * * *